US008744283B2

(12) United States Patent
Kabai et al.

(10) Patent No.: US 8,744,283 B2
(45) Date of Patent: Jun. 3, 2014

(54) IMAGE FORMING APPARATUS AND IMAGE FORMING METHOD

(75) Inventors: Takahito Kabai, Shizuoka (JP); Yasuo Goto, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 186 days.

(21) Appl. No.: 13/090,313

(22) Filed: Apr. 20, 2011

(65) Prior Publication Data

US 2011/0274445 A1 Nov. 10, 2011

Related U.S. Application Data

(60) Provisional application No. 61/331,151, filed on May 4, 2010.

(51) Int. Cl.
*G03G 15/00* (2006.01)

(52) U.S. Cl.
USPC ..... 399/12

(58) Field of Classification Search
USPC ..... 399/12, 13
See application file for complete search history.

(56) References Cited

U.S. PATENT DOCUMENTS

| | | | |
|---|---|---|---|
| 6,498,905 | B1 | 12/2002 | Tsuruya |
| 6,915,094 | B2 | 7/2005 | Tsuruya et al. |
| 7,020,419 | B2 | 3/2006 | Tsuruya et al. |
| 7,031,623 | B2 | 4/2006 | Haramoto |
| 7,239,815 | B2 | 7/2007 | Takahashi |
| 7,499,655 | B2 | 3/2009 | Yamauchi et al. |
| 2003/0133719 | A1 | 7/2003 | Tsuruya et al. |
| 2004/0101320 | A1 | 5/2004 | Haramoto |
| 2005/0163532 | A1 | 7/2005 | Tsuruya et al. |
| 2005/0254837 | A1 | 11/2005 | Takahashi |

(Continued)

FOREIGN PATENT DOCUMENTS

| | | | |
|---|---|---|---|
| EP | 1329777 | A2 | 7/2003 |

(Continued)

OTHER PUBLICATIONS

Partial European Search Report dated Feb. 18, 2013 for EP Application No. 11 16 3490, 7 pages.
Japanese Office Action for Japanese Patent Application No. 2011-094879 mailed on Sep. 3, 2013.
Extended European Search Report for European Patent Application No. 11163490.3 issued on Jun. 4, 2013.
Japanese Office Action for Japanese Patent Application No. 2011-094879 mailed on Dec. 10, 2013.

*Primary Examiner* — Walter L Lindsay, Jr.
*Assistant Examiner* — Barnabas Fekete
(74) *Attorney, Agent, or Firm* — Amin, Turocy & Watson, LLP

(57) ABSTRACT

According to one embodiment, an image forming apparatus includes an identification-section detecting device configured to detect, on the basis of an identification section included in a developer cartridge, a type of a developer stored by the developer cartridge and detect, on the basis of an identification section included in a developing device, a type of a developer used by the developing device and a control section configured to determine, on the basis of an output of the identification-section detecting device, whether the type of the developer stored by the developer cartridge and the type of the developer used by the developing device coincide with each other, prohibit from performing image formation if the types of the developers do not coincide with each other, and set an image forming method according to the determined types of the developers if the types of the developers coincide with each other.

14 Claims, 6 Drawing Sheets

(56) References Cited

U.S. PATENT DOCUMENTS

| | | | | |
|---|---|---|---|---|
| 2006/0115283 | A1 | 6/2006 | Yamauchi et al. | |
| 2008/0118255 | A1* | 5/2008 | Cronin et al. | 399/12 |
| 2009/0154970 | A1* | 6/2009 | Yoshida et al. | 399/341 |
| 2010/0119264 | A1* | 5/2010 | Yamaguchi et al. | 399/262 |

FOREIGN PATENT DOCUMENTS

| | | |
|---|---|---|
| JP | 03-026144 | 3/1991 |
| JP | 2001-083862 | 3/2001 |
| JP | 2005-326740 | 11/2005 |
| JP | 2006-154485 | 6/2006 |

* cited by examiner

IMAGE FORMING APPARATUS AND IMAGE FORMING METHOD

CROSS-REFERENCE TO RELATED APPLICATIONS

This application is based upon and claims the benefit of priority from the prior the U.S. patent application Ser. No. 61/331,151, filed on May 4, 2010, and the entire contents of which are incorporated herein by reference.

FIELD

Embodiments described herein relates generally to an image forming apparatus and an image forming method.

BACKGROUND

In recent years, from the viewpoint of resource saving, an image forming apparatus that forms an image using an erasable developer is used. The erasable developer includes materials different from materials of a normal unerasable developer. Therefore, a different image forming method needs to be set.

Specifically, image forming conditions of the erasable developer, such as surface potential, developing bias potential, transfer bias potential, charge removing bias potential, fixing temperature, and process speed different from those of the normal developer need to be set.

In the past, an image forming apparatus in which the erasable developer is used and an image forming apparatus in which the normal developer is used are respectively manufactured exclusively for specific purposes. A user has to purchase both the image forming apparatuses.

Therefore, an image forming apparatus is developed in which the erasable developer and the unerasable developer can be selectively used by replacing cartridges and designating a type of a developer from a control panel.

However, the user often cannot identify which type developer a currently inserted cartridge is.

Concerning this point, there is proposed a technique in which an identification section such as a projection or a radio tag is provided in a cartridge and an image forming apparatuses determines a type of a developer on the basis of the identification section.

However, if a cartridge is of a type in which a developer cartridge and a developing device can be separated, it is inconvenient for the user to simply identify a type of a developer. This is because the user has to manually change setting according to the type of the developer.

Therefore, there is a demand for an image forming apparatus and an image forming method that can perform appropriate image formation even if a developer cartridge and a developing device can be separated.

DETAILED DESCRIPTION

Throughout this description, the embodiments and examples shown should be considered as exemplars, rather than limitations on the apparatus and methods of the present embodiments.

Exemplary embodiments of an image forming apparatus and an image forming method are explained in detail below with reference to the accompanying drawings. In the following explanation, examples of an image forming apparatus include a copying machine, a MFP (Multifunction Peripheral), and a printer.

In general, according to one embodiment, an image forming apparatus includes: an image bearing member configured to bear an electrostatic latent image; a developing device configured to supply a developer to the image bearing member; a developer cartridge configured to store the developer on the inside thereof; a cartridge side identification section provided in the developer cartridge and configured to store a type of the developer stored by the developer cartridge; a developing device side identification section provided in a unit including at least the developing device and configured to store a type of a developer used by the developing device; a detecting section configured to detect, on the basis of the cartridge side identification section and the developing device side identification section, the types of the developer stored by the developer cartridge and the developer used by the developing device; and a control section configured to prohibit, on the basis of a detection result of the detecting section, the image forming apparatus from performing image formation if the type of the developer stored by the developer cartridge and the type of the developer used by the developing device do not coincide with each other.

Figure 1:
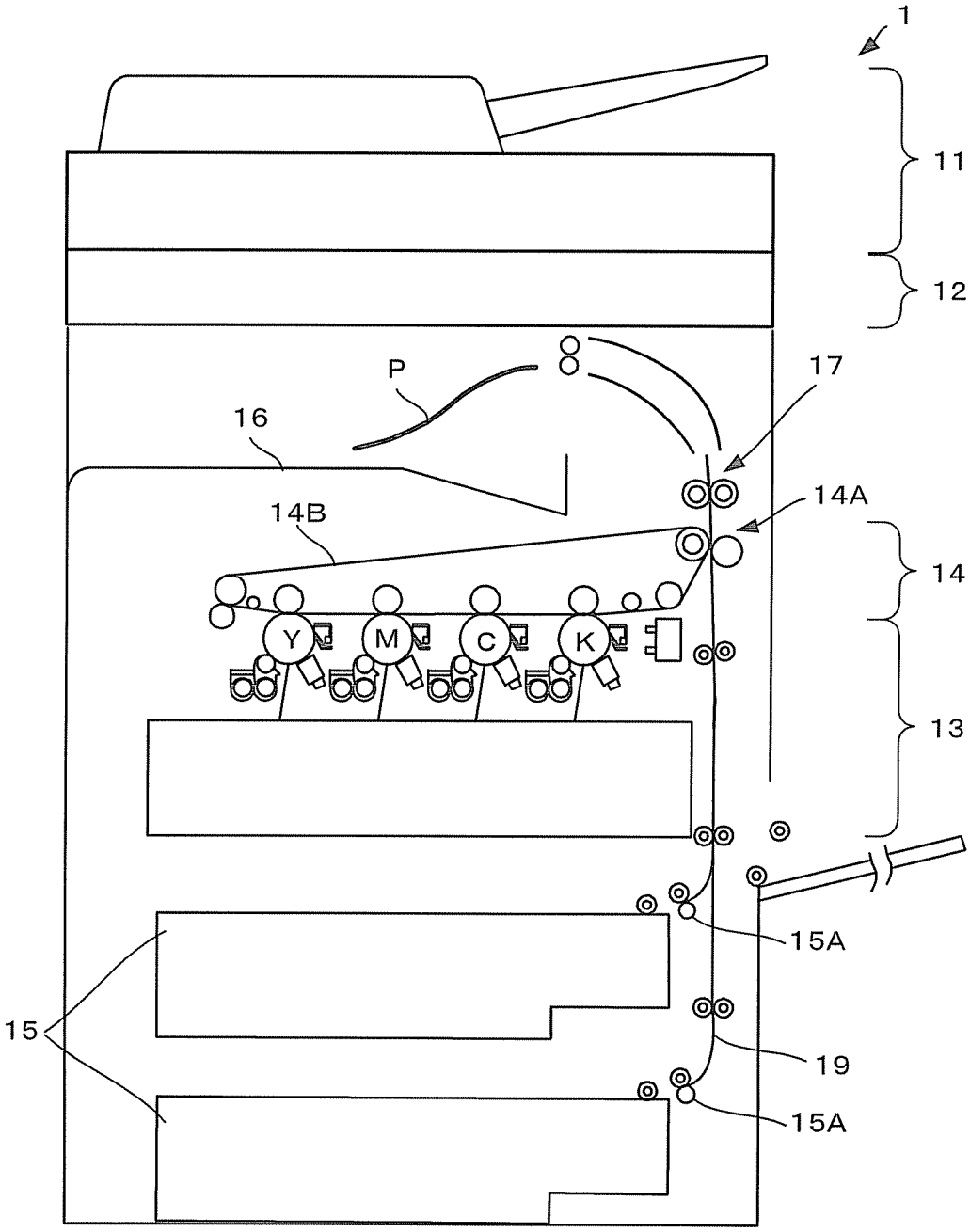
FIG. 1 is a diagram of the configuration of an image forming apparatus.

FIG. 1 is a diagram of the configuration of an image forming apparatus 1 according to an embodiment. As shown in FIG. 1, the image forming apparatus 1 includes an auto document feeder 11, an image reading section 12, an image forming section 13, a transfer section 14, a recording-medium conveying mechanism 19, and a paper feeding unit 15.

The image forming apparatus 1 includes the auto document feeder 11 openably and closably provided in an upper part of a main body of the image forming apparatus 1. The auto document feeder 11 includes a document conveying mechanism configured to extract documents from a paper feeding tray one by one and convey the document to a paper discharge tray.

The auto document feeder 11 conveys, with the document conveying mechanism, the documents to a document reading section of the image reading section 12 one by one. It is also possible to open the auto document feeder 11 and place a document on a document table of the image reading section 12.

The image reading section 12 includes a carriage including an exposure lamp configured to expose a document to light and a first reflection mirror, plural second reflection mirrors locked to a main body frame of the image forming apparatus 1, a lens block, and a CCD (Charge Coupled Device) of an image reading sensor.

The carriage stands still in the document reading section or reciprocatingly moves under the document table to reflect the light of the exposure lamp, which is reflected by the document, to the first reflection mirror. The plural second reflection mirrors reflect the reflected light of the first reflection mirror to the lens block. The lens block outputs the reflected light to the CCD. The CCD converts the incident light into an electric signal and outputs the electric signal to the image forming section 13 as an image signal.

The image forming section 13 includes, for each of yellow Y, magenta M, cyan C, and black K, a laser irradiation unit, a photoconductive drum serving as an image bearing member, and a developing device.

The laser irradiation unit serving as an electrostatic-latent-image forming section irradiates a laser beam on the photoconductive drum on the basis of the image signal and forms an electrostatic latent image on the photoconductive drum. The developing device supplies a developer to the photoconductive drum and forms a developer image from the electrostatic latent image.

The recording-medium conveying mechanism 19 includes, most upstream on the paper feeding unit 15 side, pickup mechanisms 15A configured to extract recording media one by one.

The pickup mechanisms 15A extract recording media from the paper feeding unit 15 one by one and pass the recording medium to the recording-medium conveying mechanism 19. The recording-medium conveying mechanism 19 conveys the recording medium to the transfer section 14.

The transfer section 14 includes a transfer belt 14B, a transfer roller 14A, and a fixing device 17. The transfer belt 14B is wound around an opposed roller opposed to the transfer roller 14A. The transfer belt 14B serving as an image bearing member receives the transfer of the developer image on the photoconductive drum and bears the developer image. The transfer roller 14A applies a voltage to the developer image on the transfer belt 14B and transfers the developer image onto a recording medium conveyed to the transfer roller 14A. The fixing device 17 heats and presses the developer image and fixes the developer image on the recording medium.

In another embodiment, the image forming apparatus 1 directly transfers the developer image from the photoconductive drum onto the recording medium. In this case, the transfer roller 14A is arranged to be opposed to the photoconductive drum.

A recording medium P discharged from a paper discharge port is stacked on a paper discharge tray 16 serving as a carrying section configured to carry the recording medium P.

An erasable developer contains a color assuming compound, a color developing agent, and a decolorizer. Examples of the color assuming compound include a leuco dye. Examples of the color developing agent include phenol. Examples of the decolorizer include a substance that is compatible with the color assuming compound when heated and does not have affinity with the color developing agent.

The erasable developer develops a color according to an interaction between the color assuming compound and the color developing agent. The erasable developer erases the color because the interaction between the color assuming compound and the color developing agent is interrupted by heating to temperature equal to or higher than erasing temperature.

Figure 2:
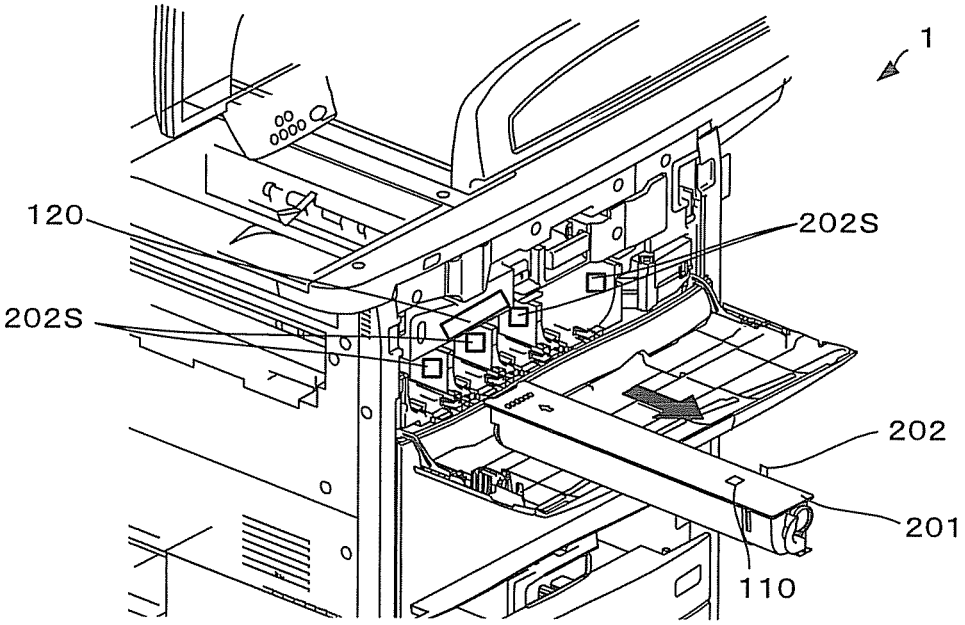
FIG. 2 is a diagram of a state in which a developer cartridge is drawn out from the image forming apparatus.

FIG. 2 is a diagram of a state in which a developer cartridge 201 is drawn out from the image forming apparatus 1. The developer cartridge 201 stores a developer on the inside thereof and is inserted into the image forming apparatus 1 as shown in FIG. 2.

The developer cartridge 201 includes, in a housing thereof, an identification section that indicates a type of the developer. Examples of the identification section include a radio tag 110 and an identification projection 202. However, the identification section is not limited to the radio tag 110 and the identification projection 202.

The image forming apparatus 1 includes an identification-section detecting device configured to detect a type of the developer cartridge 201 on the basis of the identification section.

If the developer cartridge 201 includes the radio tag 110 as the identification section, the image forming apparatus 1 includes, as the identification-section detecting device, a reader writer 120 capable of reading data from and writing data in the radio tag 110 in a position in the image forming apparatus 1 where the reader writer 120 can communication with the radio tag 110.

The radio tag 110 stores developer cartridge identification information such as types of erasability and unerasability of developers, information concerning colors, and information concerning a use history.

If the developer cartridge 201 includes the identification projection 202 as the identification section, the image forming apparatus 1 includes, as the identification-section detecting device, an identification sensor 202S in a position in the image forming apparatus 1 where the identification sensor 202S can identify the identification projection 202.

The identification sensor 202S may be a mechanical sensor including an actuator or an optical sensor.

Figure 3:
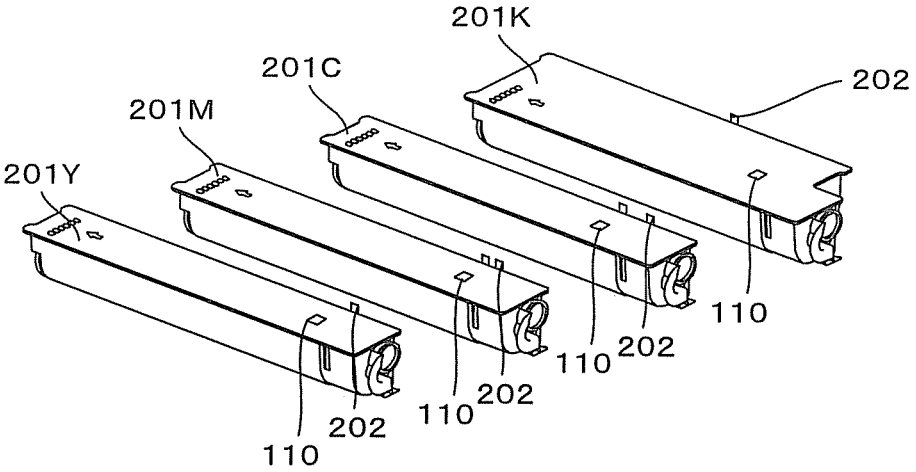
FIG. 3 is a diagram of an example of the developer cartridge.

FIG. 3 is a diagram of an example of the developer cartridge 201. As shown in FIG. 3, in the case of a color image forming apparatus 1, developer cartridge identification information written in the radio tag 110 is different and the position and the number of identification projections 202 are different among types of erasability and unerasability and among a developer cartridge 201Y for yellow, a developer cartridge 201M for magenta, a developer cartridge 201C for cyan, and a developer cartridge 201K for black.

Figure 4:
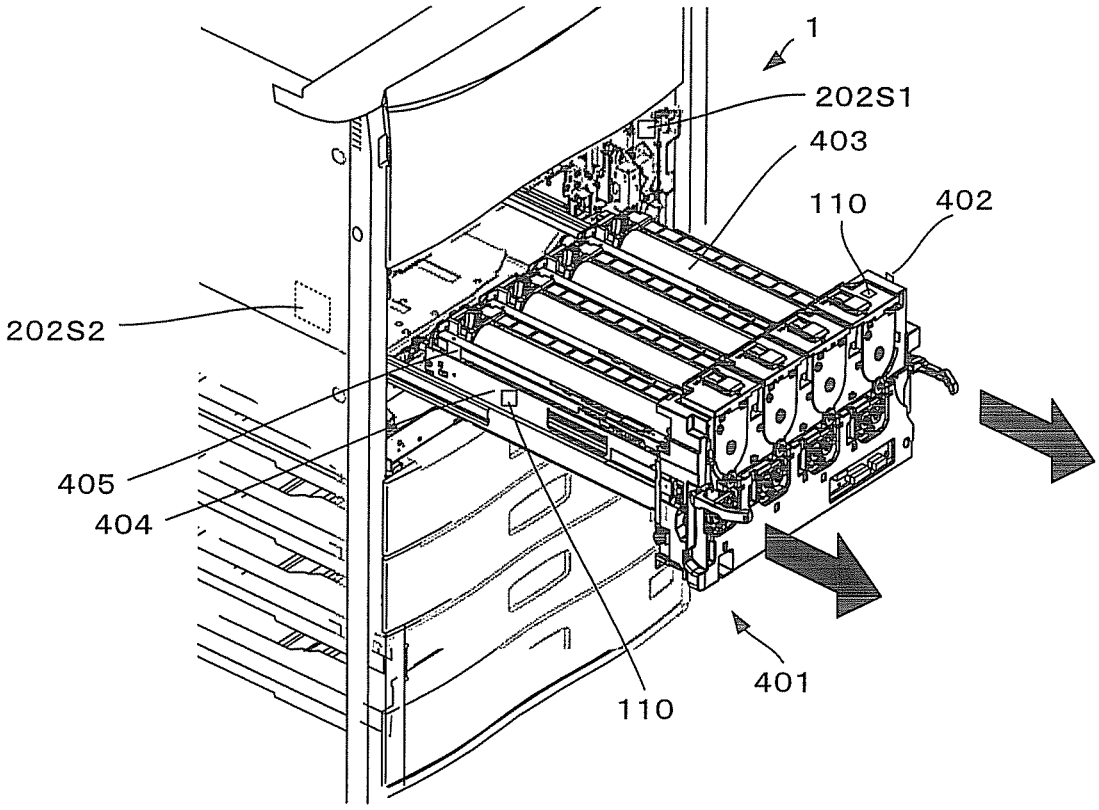
FIG. 4 is a diagram of a state in which a developing device is drawn out from the image forming apparatus.

FIG. 4 is a diagram of a state in which a process unit 401 is drawn out from the image forming apparatus 1. As shown in FIG. 4, the process unit 401 includes a photoconductive drum 403 serving as an image bearing member, a developing device 404 configured to supply a developer to the photoconductive drum 403, and an identification section set in a housing of the developing device 404 and used when a type of the developer used by the developing device 404 is identified.

Examples of the identification section include the radio tag 110 and the identification projection 202. However, the identification section is not limited to the radio tag 110 and the identification projection 202.

The image forming apparatus 1 includes an identification-section detecting device configured to detect, on the basis of the identification section, a type of a developer corresponding to the identification section used by the developing device 404.

If the developing device 404 includes the radio tag 110 as the identification section, the image forming apparatus 1 includes, as the identification-section detecting device, the reader writer 120 capable of reading data from and writing data in the radio tag 110 in a position in the image forming apparatus 1 where the reader writer 120 can communication with the radio tag 110. As the reader writer 120, the reader writer 120 shown in FIG. 3 and explained above can be used.

The radio tag 110 stores developing device identification information such as types of erasability and unerasability of developers used by the developing device 404, information concerning colors, and information concerning a use history.

If the process unit 401 includes an identification projection 402 as the identification section, the image forming apparatus 1 includes, as the identification-section detecting device, an identification sensor 202S1 in a position in the image forming apparatus 1 where the identification sensor 202S1 can identify the identification projection, 402.

The identification sensor 202S1 may be a mechanical sensor including an actuator or an optical sensor.

If the developing device 404 or the photoconductive drum 403 can be separated from the process unit 401, radio tags 110 and identification projections 405 can be provided in the developing device 404 and the photoconductive drum 403 as identification sections.

If the developing device 404 includes the identification projection 405, the image forming apparatus 1 includes an identification sensor 202S2 in a position in the image forming apparatus 1 where the identification sensor 202S2 can identify the identification projection 405.

Figure 5:
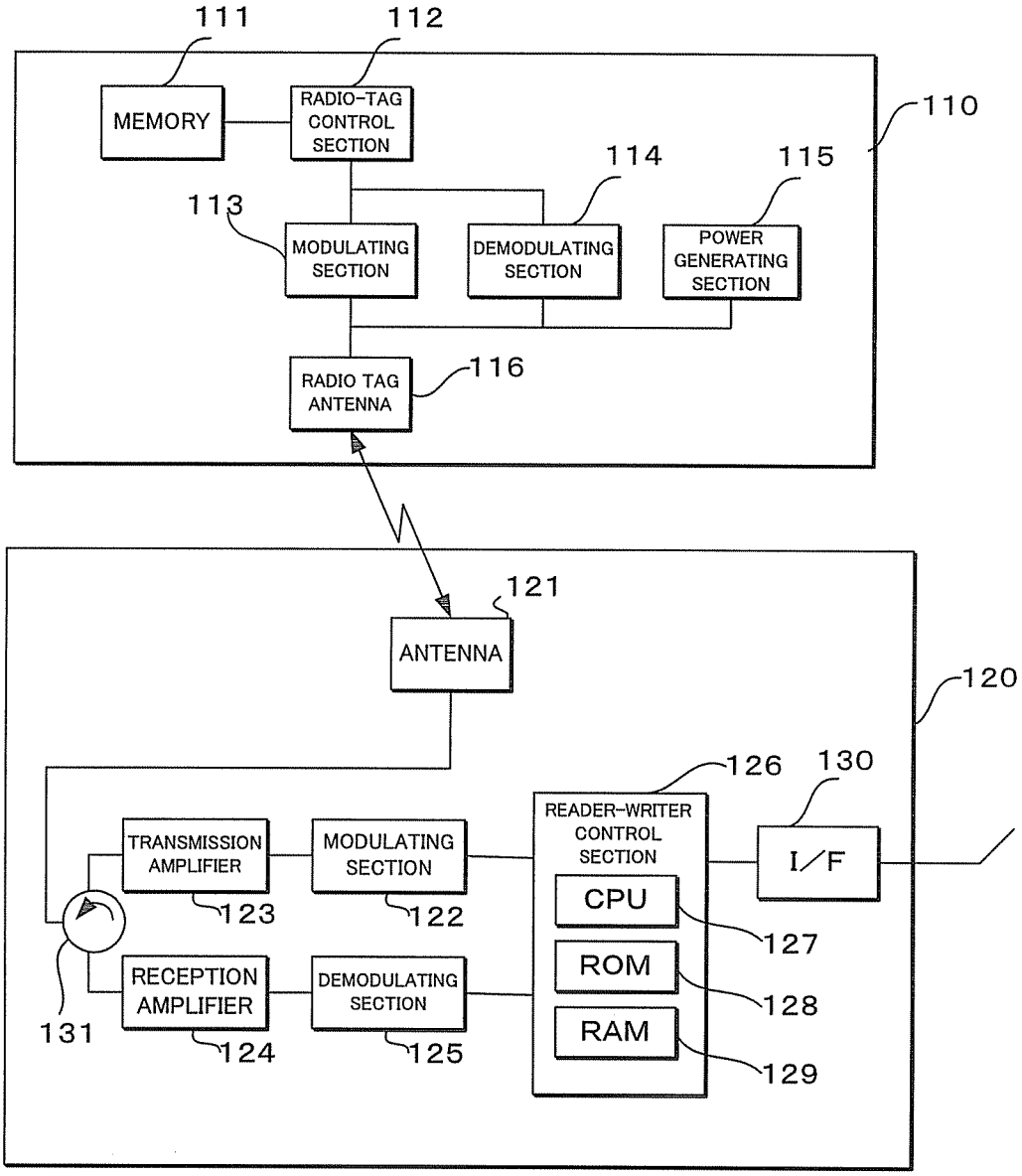
FIG. 5 is a block diagram of the configurations of a radio tag and a reader writer.

FIG. 5 is a block diagram of the configurations of the radio tag 110 and the reader writer 120. As shown in FIG. 5, the radio tag 110 includes a memory 111 serving as a storage device, a radio-tag control section 112 configured to read data from and write data in the memory 111, a power generating section 115 configured to perform rectification and stabilization of a received modulated electromagnetic wave to thereby supply power, a radio tag antenna 116 serving as an antenna for transmitting and receiving signals, a modulating section 113 configured to modulate data sent from the radio-tag control section 112 and send the data to the radio tag antenna 116, and a demodulating section 114 configured to demodulate the received modulated electromagnetic wave and send the electromagnetic wave to the radio-tag control section 112.

The reader writer 120 includes a reader-writer control section 126 configured to control communication with the radio tag 110 and control hardware connected to the reader writer 120, a modulating section 122 configured to modulate a signal sent from the reader-writer control section 126, a transmission amplifier 123 configured to amplify the modulated signal and send the signal to an antenna 121 via a circulator 131, a reception amplifier 124 configured to amplify modulated electromagnetic waves received from the antennas via the circulator 131, a demodulating section 125 configured to demodulate a received modulated signal, and an interface 130 connected to a control section of the image forming apparatus 1 and perform exchange of data. The reader-writer control section 126 includes a CPU 127 and a ROM 128 and a RAM 129 serving as memories configured to store data.

Figure 6:
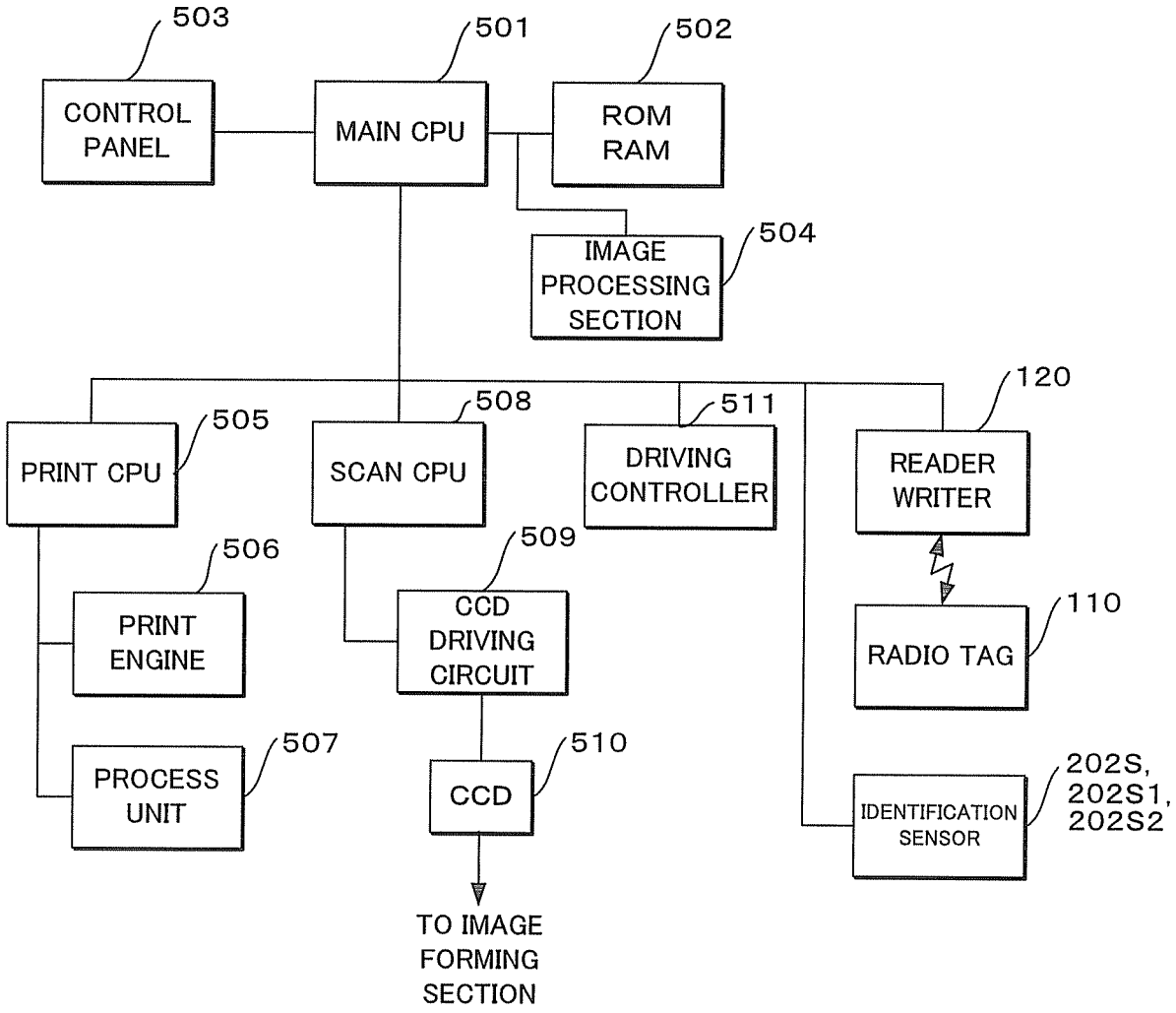
FIG. 6 is a block diagram of the configuration of the image forming apparatus.

FIG. 6 is a block diagram of the configuration of the image forming apparatus 1. As shown in FIG. 6, the image forming apparatus 1 includes a main CPU 501 serving as a control section, a control panel 503 serving as a display input device, a ROM and RAM 502 serving as a storage device, and an image processing section 504 configured to perform image processing.

The main CPU 501 is connected to and controls a print CPU 505, a scan CPU 508, a driving controller 511, and the reader writer 120 included in the image forming apparatus 1. The main CPU 501 receives input of signals from the identification sensors 202S, 202S1, and 202S2.

The print CPU 505 is connected to and controls a print engine 506 configured to perform image formation and a developing device 507 including a transfer device.

The scan CPU 508 controls a CCD driving circuit 509 configured to drive a CCD 510. An output of the CCD 510 is output to the image forming section 13.

The driving controller 511 controls the recording-medium conveying mechanism 19.

Figure 7:
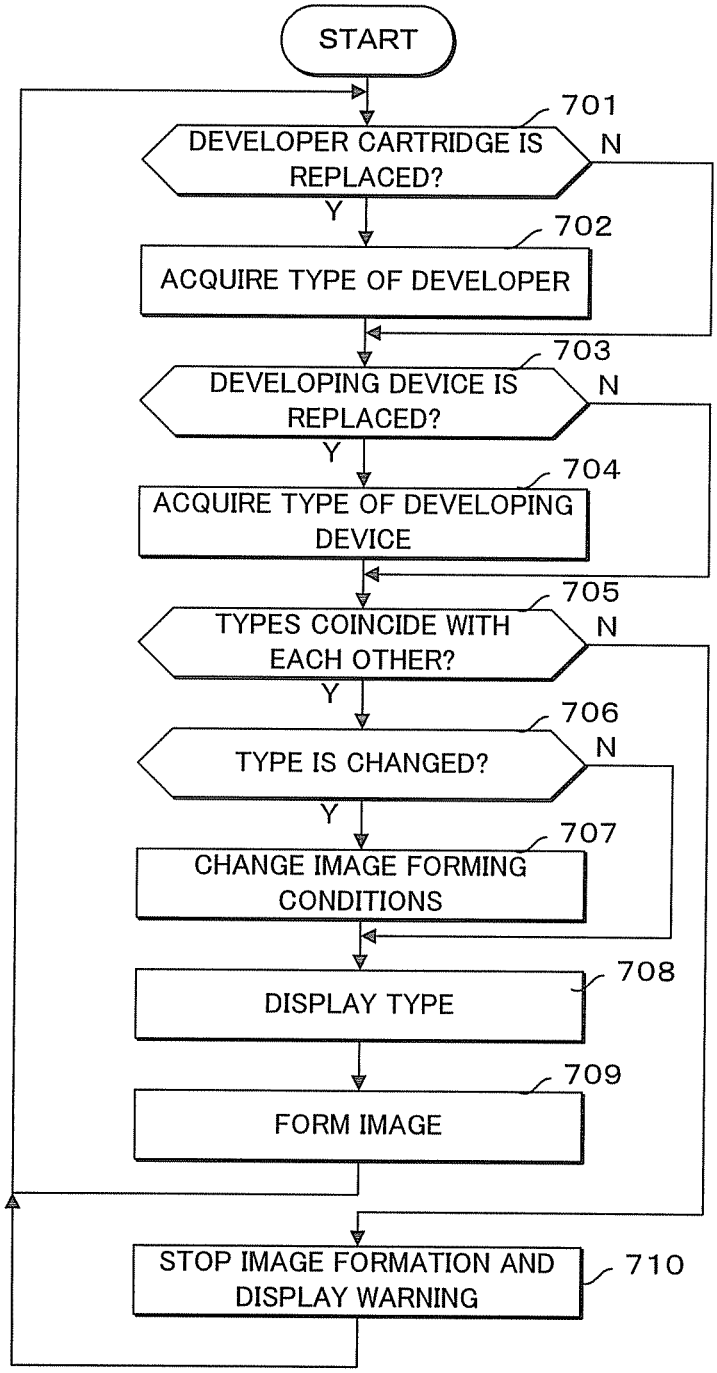
FIG. 7 is a flowchart for explaining the operation of an image forming method determining device of the image forming apparatus.

FIG. 7 is a flowchart for explaining the operation of an image forming method determining device of the image forming apparatus 1. As shown in FIG. 7, in Act 701, the image forming apparatus 1 determines, on the basis of developer cartridge identification information read out from the radio tag 110 by the reader writer 120 or an output of the identification sensor 202S, whether the developer cartridge 201 is replaced. If the image forming apparatus 1 determines that the developer cartridge 201 is replaced, the image forming apparatus 1 proceeds to Act 702. If the image forming apparatus 1 does not determine that the developer cartridge 201 is replaced, the image forming apparatus 1 proceeds to Act 703.

In Act 702, the image forming apparatus 1 acquires, on the basis of the developer cartridge identification information read out from the radio tag 110 by the reader writer 120 or the output of the identification sensor 202S, a type of erasability or unerasability of a developer stored in the developer cartridge 201.

In Act 703, the image forming apparatus 1 determines, on the basis of developing device identification information read out from the radio tag 110 by the reader writer 120 or an output of the identification sensor 202S1, whether the developing device 404 is replaced. If the image forming apparatus 1 determines that the developing device 404 is replaced, the image forming apparatus 1 proceeds to Act 704. If the image forming apparatus 1 does not determine that the developing device 404 is replaced, the image forming apparatus 1 proceeds to Act 705.

In Act 704, the image forming apparatus 1 acquires, on the basis of the developing device identification information read out from the radio tag 110 by the reader writer 120 or the output of the identification sensor 202S1, a type of erasability or unerasability of a developer used by the developing device 404.

In Act 705, the image forming apparatus 1 determines whether a type of the developer cartridge 201 and the type of the developer used by the developing device 404 coincide with each other.

If the image forming apparatus 1 is an image forming apparatus for monochrome printing, the image forming apparatus 1 determines whether the type of the developer cartridge 201 and the type of the developer used by the developing device 404 coincide with each other.

If the image forming apparatus 1 is capable of performing color printing, the image forming apparatus 1 determines whether types of all plural developer cartridges 201 and the type of the developer used by the developing device 404 coincide with each other. If a type of at least one of the plural developer cartridges 201 is different, the image forming apparatus 1 does not determine that the types of the developer cartridges 201 and the type of the developer coincide with each other.

If the image forming apparatus 1 determines that the type of the developer cartridge 201 and the type of the developer used by the developing device 404 coincide with each other, the image forming apparatus 1 proceeds to Act 706. If the image forming apparatus 1 does not determine that the type of the developer cartridge 201 and the type of the developer coincide with each other, the image forming apparatus 1 proceeds to Act 710.

In Act 706, the image forming apparatus 1 determines whether a type of the developer cartridge 201 or the developing device 404 before the replacement is changed after the replacement. If there is a change in the type, the image forming apparatus 1 proceeds to Act 707. If there is no change in the type, the image forming apparatus 1 proceeds to Act 708.

In Act 707, the image forming apparatus 1 changes image forming conditions before the change to image forming conditions such as surface potential, developing bias potential, transfer bias potential, charge removing bias potential, fixing temperature, and process speed corresponding to the type after the change.

In Act 708, the image forming apparatus 1 displays the type after the change on the control panel 503.

In Act 709, the image forming apparatus 1 performs image formation under the image forming conditions after the change and returns to Act 701.

In Act 710, the image forming apparatus 1 stops the image formation, displays, on the control panel 503, an indication to the effect that the type of the developer cartridge 201 and the type of the developer used by the developing device 404 do not coincide with each other and displays the developer cartridge 201 or the developing device 404, the type of which does not coincide with the type of the other, and returns to Act 701.

The operation of the image forming method determining device of the image forming apparatus 1 during the replacement of the developing device 404 is shown in FIG. 7. However, the image forming method determining device of the image forming apparatus 1 can perform the same operation during the replacement of the process unit 401.

As explained above, the image forming apparatus 1 according to this embodiment includes the identification-section detecting device configured to detect, on the basis of the identification section included in the developer cartridge 201, a type of a developer stored by the developer cartridge 201 and detect, on the basis of the identification section included in the developing device 404, a type of a developer used by the developing device 404 and the control section configured to determine, on the basis of an output of the identification-section detecting device, whether the type of the developer stored by the developer cartridge 201 and the type of the developer used by the developing device 404 coincide with each other, prohibit from performing image formation if the types of the developers do not coincide with each other, and set an image forming method according to the determined types of the developers if the types of the developers coincide with each other.

Therefore, there is an effect that, even when the developer cartridge 201 and the developing device 404 can be separated, appropriate image formation corresponding to a type of a developer is possible.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An image forming apparatus comprising:

an image bearing member configured to bear an electrostatic latent image;

a plurality of developing devices configured to supply a developer to the image bearing member;

a plurality of developer cartridges configured to store the developer on an inside thereof;

a plurality of cartridge side identification sections provided in the developer cartridge and configured to store a color and types indicating erasability or unerasability of developers of the developer stored by each of the developer cartridges;

a plurality of developing device side identification sections provided in a unit including at least the developing device and configured to store a color and types indicating erasability or unerasability of a developer used by each of the developing devices;

an identification-section detecting device configured to detect, on the basis of the cartridge side identification section and the developing device side identification section, the color and the types of the developer stored by the developer cartridge and the developer used by the developing device; and a control section configured to prohibit, on the basis of a detection result of the identification-section detecting device, the image forming apparatus from performing image formation, on performing color printing, unless the type of the developer stored by the developer cartridge and the type of the developer used by the developing device coincide with each other, and on performing color printing, unless the type of the developer stored by the developer cartridge and the type of the developer used by the developing device coincide with each other among all colors.

2. The apparatus according to claim 1, wherein the control section causes, if the type of the developer stored by the developer cartridge and the type of the developer used by the developing device do not coincide with each other on the basis of an output of the identification-section detecting device, a display device to display information indicating that the types of the developers do not coincide with each other.

3. The apparatus according to claim 2, wherein the control section sets, if the type of the developer stored by the developer cartridge and the type of the developer used by the developing device coincide with each other on the basis of the output of the identification-section detecting device, an image forming method according the determined types of the developers.

4. The apparatus according to claim 3, wherein the identification sections are radio tags, and the identification-section detecting device is a reader writer.

5. The apparatus according to claim 4, wherein the radio tag provided in the developer cartridge stores developer cartridge identification information including types of erasability and unerasability of developers, and the radio tag provided in the developing device stores developing device identification information including types of erasability and unerasability of developers used by the developing device.

6. The apparatus according to claim 3, wherein the identification sections are identification projections, and the identification-section detecting device is a sensor.

7. The apparatus according to claim 6, wherein the identification projections are different in any one of a shape, a position, and a number according to types of developers.

8. An image forming method for an image forming apparatus comprising:

detecting, with an identification-section detecting device, on the basis of a cartridge side identification section provided in a developer cartridge and configured to store a color and types indicating erasability or unerasability of a developer stored by the developer cartridge, the color and types indicating erasability or unerasability of the developer stored by the developer cartridge;

detecting, with the identification-section detecting device, on the basis of a developing device side identification section provided in a unit including at least a developing device and configured to store a color and types indicating erasability or unerasability of a developer used by the developing device, the color and types indicating erasability or unerasability of the developer used by the developing device; and prohibiting the image forming apparatus from performing image formation on performing color printing, unless the type of the developer stored by the developer cartridge and the type of the developer used by the developing device coincide with each other, and on performing color printing, unless the type of the developer stored by the developer cartridge and the type of the developer used by the developing device coincide with each other among all colors.

9. The method according to claim 8, further comprising causing, if the type of the developer stored by the developer cartridge and the type of the developer used by the developing device do not coincide with each other on the basis of an output of an identification-section detecting device, a display device to display information indicating that the types of the developers do not coincide with each other.

10. The method according to claim 9, further comprising setting, if the type of the developer stored by the developer cartridge and the type of the developer used by the developing device coincide with each other on the basis of an output of the identification-section detecting device, an image forming method according the determined types of the developers.

11. The method according to claim 10, wherein the identification sections are radio tags, and the identification-section detecting device is a reader writer.

12. The method according to claim 11, wherein the radio tag provided in the developer cartridge stores developer cartridge identification information including types of erasability and unerasability of developers, and the radio tag provided in the developing device stores developing device identification information including types of erasability and unerasability of developers used by the developing device.

13. The method according to claim 10, wherein the identification sections are identification projections, and the identification-section detecting device is a sensor.

14. An image forming apparatus comprising:

a plurality of image bearing members;

a plurality of developing devices configured to use developer to form developer images on the plurality of image bearing members respectively;

a plurality of developer cartridges configured to store the developer inside thereof respectively, the one of the plurality of developer cartridges having a predetermined corresponding relationship with one of the plurality of developing devices relating to the supplying of the developer;

a plurality of cartridge side identification sections provided to the developer cartridges respectively, each of the plurality of cartridge side identification sections being configured to store a color and a type of the developer stored inside in the one of the developer cartridges respectively, the type showing if the stored developer is erasable or not;

a plurality of developing device side identification sections provided in the plurality of developing devices respectively, each of the plurality of developing device side identification sections being configured to store a color and a type of the developer used by the one of the developing devices respectively, the type showing if the used developer is erasable or not;

an identification-section detecting device configured to detect, the colors and the types of the developers stored in the developer cartridges and the colors and the types of the developers used by the developing devices, on the basis of the cartridge side identification sections and the developing device side identification sections;

a control section configured to prohibit the image forming apparatus from performing image formation, unless between each of the developer cartridges and each of the developing devices which has the predetermined corresponding relationship with the each of the developer cartridges, the colors and the types coincide.

* * * * *